US005151020A

United States Patent [19]

Mori et al.

[11] Patent Number: 5,151,020

[45] Date of Patent: Sep. 29, 1992

[54] SCROLL TYPE COMPRESSOR HAVING GRADUALLY THINNED WALL THICKNESS

[75] Inventors: Tatsushi Mori; Hisao Kobayashi; Yuji Izumi, all of Kariya, Japan

[73] Assignee: Kabushiki Kaisha Toyoda Jidoshokki Seisakusho, Kariya, Japan

[21] Appl. No.: 745,488

[22] Filed: Aug. 15, 1991

[30] Foreign Application Priority Data

Sep. 13, 1990 [JP] Japan ..... 2-245364

[51] Int. Cl.[5] ..... F04C 18/04

[52] U.S. Cl. ..... 418/55.2; 418/50

[58] Field of Search ..... 418/55.2, 150

[56] References Cited

U.S. PATENT DOCUMENTS 4,382,754 5/1983 Shaffer et al. ..... 418/55.2
4,490,099 12/1984 Terauchi et al. ..... 418/55.2
4,627,800 12/1986 Matsudaira et al. ..... 418/55.2

FOREIGN PATENT DOCUMENTS 60-98186 6/1985 Japan .
1-63680 3/1989 Japan ..... 418/55.2

*Primary Examiner*—John J. Vrablik
*Attorney, Agent, or Firm*—Brooks Haidt Haffner & Delahunty

[57] ABSTRACT

A scroll type compressor has a stationary scroll (1) and a movable scroll (2) rotating around the former in an orbital manner, while forming volume variable sealed spaces therebetween to compress a coolant gas. To reduce a wall thickness of the scroll, an outer wall curve ($E_1+$) of the scroll (1,2) is defined by the modification of a basic involute curve ($D+$) by reducing a certain value $B\theta^n$) from a length ($L_0$) of the respective involute line of the basic involute curve, which value is increased as the involute angle ($\theta$) is developed, and an inner wall curve ($E_1-$) is generated from the outer wall curve ($E_1+$) by first transferring the respective point ($p_{3,4}$) on the outer wall curve ($E_1+$) in the normal direction to the outer wall curve ($E_1+$) at the respective point ($p_{3,4}$) by a distance (r) equal to a radius of the orbital circle (R) to form an intermediate curve ($E_1$) and then symmetrically transferrring the respective point ($p_5$) on the intermediate curve ($E_1$) around the center ($O_1$) of the basic circle ($C_1$).

4 Claims, 9 Drawing Sheets

SCROLL TYPE COMPRESSOR HAVING GRADUALLY THINNED WALL THICKNESS

BACKGROUND OF THE INVENTION

1. Field of the Invention

The present invention relates to a geometrical shape of a spiral body built-in to a scroll type compressor suitable for use in an automobile air-conditioner.

2. Description of the Related Arts

It is preferable to thin a wall thickness of a spiral body (hereinafter referred to as "scroll") to reduce the weight of a scroll type compressor, but the scroll is subjected to a severe counteraction of a varying compression of a medium gas. This is particularly true of the start area of the scroll, as this area is exposed to a maximum pressure, and accordingly, at least this area of a scroll should have a wall thickness sufficient to withstand such a pressure and avoid damage due to wear. In the conventional scroll type compressor, an involute curve is used as a profile of outer and inner walls of both the movable and stationary scrolls, and therefore, the wall thickness is uniform over all of the wall length. Accordingly, if the start area of the scroll has a sufficient wall thickness, it continues to the end area thereof, and thus a thinning of the scroll wall becomes impossible.

A solution is proposed in Japanese Unexamined Patent Publication (Kokai) No. 60-98186, in which a wall thickness of a movable scroll is gradually reduced toward an end area thereof, and a wall thickness of a stationary scroll is increased correspondingly. Profiles of both the outer and inner walls are involute curves, and a basic circle of the outer wall curve has a smaller diameter than that of a basic circle of the inner wall curve. The use of the basic circles, each having a different diameter, enables the wall thickness of the movable scroll to be made thinner toward the end area thereof. The reduction of the wall thickness of the movable scroll is compensated by the increase of that of the stationary scroll, so that a smooth contact between both scrolls can be ensured during the orbital motion of the movable scroll.

According to the above-mentioned proposal, nevertheless the weight of the movable scroll is reduced when enhancing the mechanical strength of the start area thereof, the weight of the stationary scroll is conversely increased, and therefore, the total weight of the compressor cannot be reduced. Further, as the profiles of the outer and inner wall are still involute curves, a reduction of a diameter of the scroll cannot be attained, which is essential to the compactness of this type of compressor.

SUMMARY OF THE INVENTION

Thus, an object of the present invention is to provide a compressor with scrolls having an improved shape by which a total weight and the size of the compressor are reduced.

This object can be achieved by a scroll type compressor comprising a stationary scroll and a movable scroll, outer and inner walls of the movable scroll confronting those of the stationary scroll and being supported to be subjected to an orbital motion along an orbital circle while prevented from spinning around its own axis, a sealed space being formed between both the scrolls, which is reduced in volume when the movable scroll is subjected to the orbital motion, profiles of walls of both the scrolls being defined by a curve generated from the modification of an involute curve of a basic circle, characterized in that a wall thickness of the stationary and movable scrolls is gradually thinned from the start area to the end area of the scrolls.

More specifically, a scroll type compressor according to the present invention is characterized in that the curve defining a profile of the outer wall (outer wall curve) is generated from a basic involute curve by lowering a certain value from a length of the respective involute line of the basic involute curve, which value is increased as the involute angle is developed; the curve defining a profile of the inner wall (inner wall curve) is generated from the outer wall curve by first transferring the respective point on the outer wall curve substantially in the normal direction to the outer wall curve at the respective point by a distance equal to a radius of the orbital circle to form an intermediate curve, and then symmetrically transferring the respective point on the intermediate curve around the center of the basic circle; wherein the involute line is defined by a segment of tangent to the basic circle at the respective involute angle, between the involute curve and the basic circle.

Preferably, in the generation of the intermediate curve, the respective point on the outer wall curve is transferred correctly in the normal direction.

Alternatively, in the generation of the intermediate curve, the respective point on the outer wall curve is transferred in the direction of the involute line at the respective point.

BRIEF DESCRIPTION OF THE DRAWINGS

The other objects and advantages of the present invention will be apparent with reference to the preferred embodiments illustrated by the following drawings.

DESCRIPTION OF THE PREFERRED EMBODIMENTS

Figure 1:
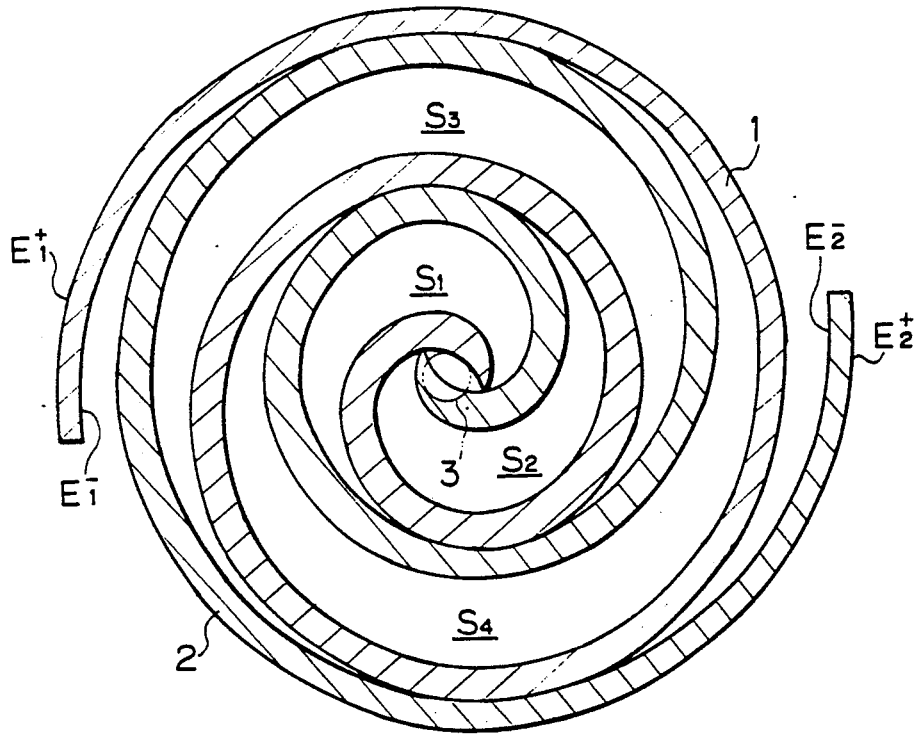
FIGS. 1 through 4 are schematic views, respectively, illustrating a sequential change of the contact between stationary and movable scrolls.
Figure 2:
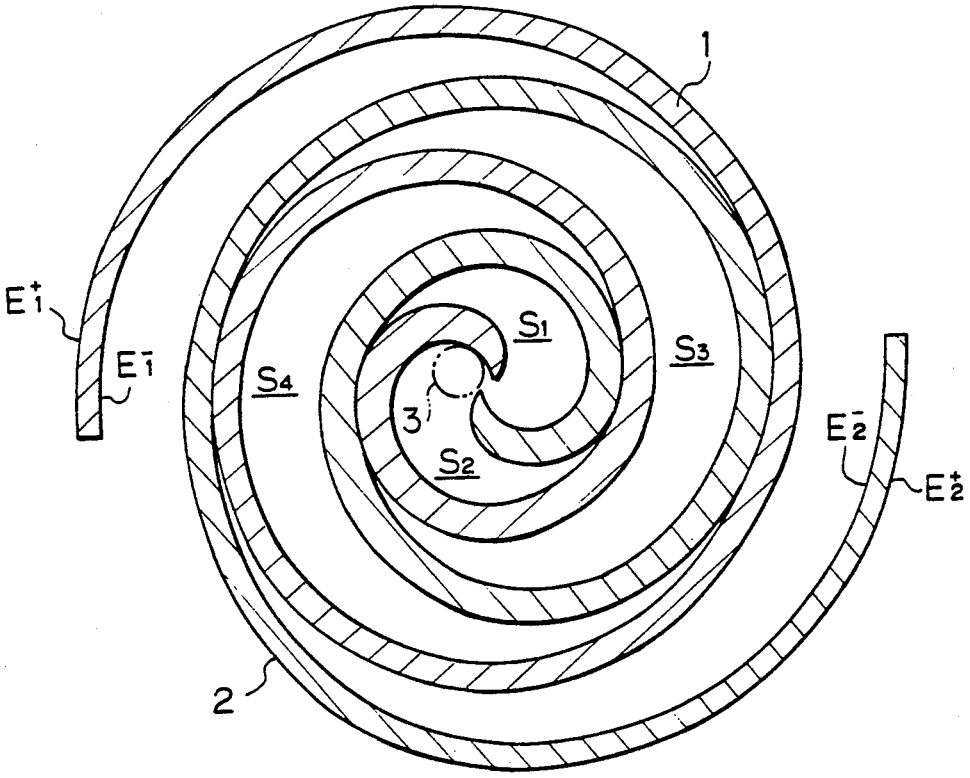
Figure 3:
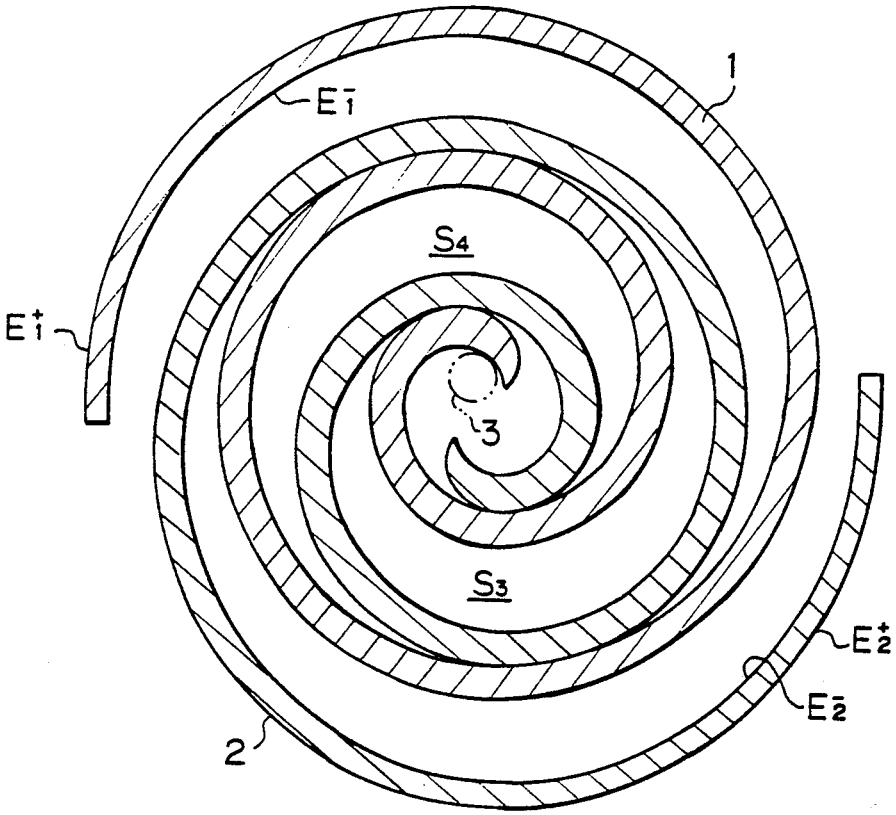
Figure 4:
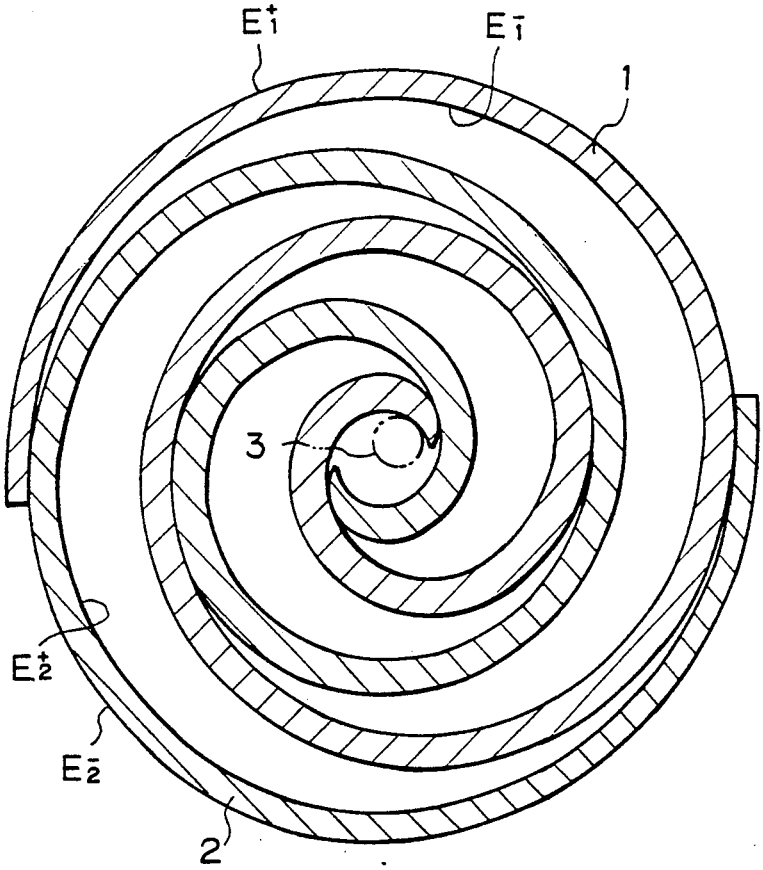

FIGS. 1 through 4 represent, respectively, a sequential change of the contact between a stationary scroll 1 and a movable scroll 2 when the movable scroll 2 moves at an angular pitch of 90° on its orbital circle. According to the orbital motion of the movable scroll 2, the volumes of a plurality of sealed spaces $S_1$, $S_2$, $S_3$ and $S_4$ between both scrolls 1 and 2 are gradually reduced so that a gas therein is compressed. In FIG. 2, spaces $S_1$ and $S_2$ are communicated with a discharge port 3 and the gas is discharged therefrom as shown in FIGS. 3 and 4. Thereafter, the next sealed spaces $S_3$ and $S_4$ are communicated with the discharge port 3 and the same steps are repeated.

Curves $E_1+$ and $E_1-$ defining, respectively, profiles of outer and inner walls of the stationary scroll 1 and curves $E_2+$ and $E_2-$ defining, respectively, profiles of outer and inner walls of the movable scroll 2 are not the conventional involute curve but are modified so that a wall thickness of the respective scrolls 1, 2 is gradually thinned toward the end area thereof.

Figure 5:
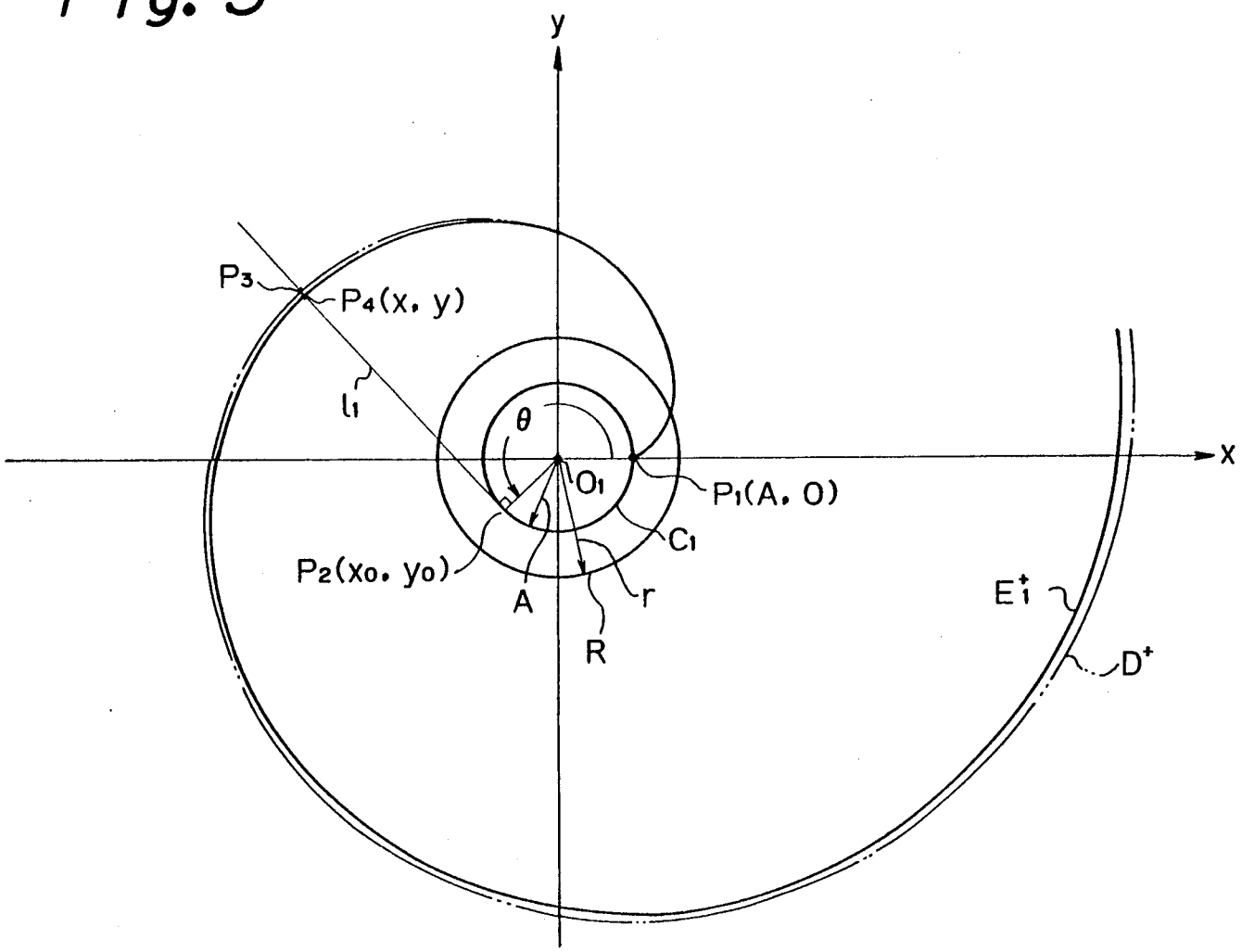
FIGS. 5 through 7 are schematic views, respectively, illustrating a sequence of a procedure for the generation of curves defining profiles of outer and inner walls of the scroll according to the present invention.

The curve depicted by a solid line in FIG. 5 is the abovesaid modified involute curve $E_1^+$ of the outer wall of the stationary scroll 1, and curve $D^+$ depicted by a chain line is a pure involute curve generated from a basic circle $C_1$ of radius A with a center positioned at an origin $O_1$ of x—y coordinates. The starting point of this involute curve $D^+$ is defined at a point $p_1$ on x axis. R designates a circle having a radius r equal to that of the orbital path of the movable scroll 2.

Curve $D^+$ is represented by $$x^2+y^2=A^2+A^2\theta^2 \tag{1}$$

wherein $\theta$ is an involute angle, a position corresponding thereto being represented on the basic circle $C_1$ by a point $p_2$ in FIG. 5.

$A\theta$ in equation (1) represents a length of an involute line corresponding to a segment between the point $p_2$ and a point $p_3$ which is an intersecting point of the involute curve $D^+$ with a tangent $\mathbf{1}_1$ to the circle $C_1$ at the point $p_2$. In general, the length of the involute line $L_0$ is expressed as a function of $\theta$ by $$L_0(\theta)=A\theta \tag{1'}$$

The curve $E_1^+$ defining the profile of the outer wall is represented by $$x^2+y^2=A^2+(A\theta-B\theta^n)^2 \tag{2}$$

wherein B is a positive constant and n is an exponent of more than two.

$(A\theta-B\theta^n)$ in equation (2) represents a distance between the point $p_2$ and a point $p_4$ which is an intersecting point of the tangent $\mathbf{1}_1$ with the curve $E_1^+$. In other words, $B\theta^n$ represents a distance between the points $p_3$ and $p_4$, and the curve $E_1^+$ is obtained by substrate $B\theta^n$ from the length of involute line. Accordingly, the outer wall curve $E_1^+$ is gradually moved away inward from the involute curve $D^+$ as the involute angle $\theta$ increases.

Figure 6:
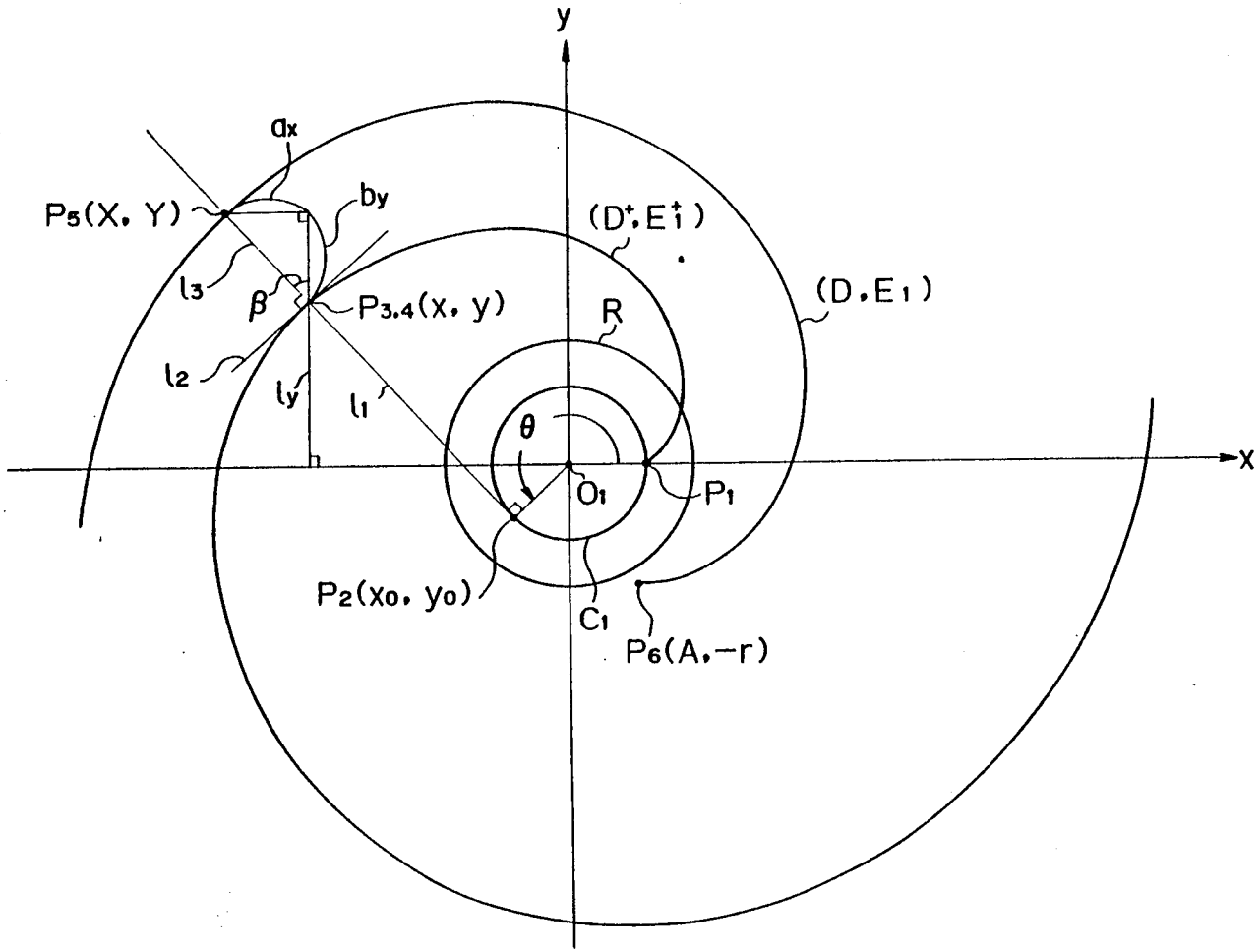

To simplify the drawing, a curve $(D^+, E_1^+)$ in FIG. 6 commonly represents the involute curve $D^+$ or the outer wall curve $E_1^+$ thus obtained. $\mathbf{1}_2$ is a tangent to the curve $(D^+, E_1^+)$ at a point $p_{3,4}$ which is an intersecting point of the tangent $\mathbf{1}_1$ at the involute angle $\theta$ with the curve $(D^+, E_1^+)$, and $\mathbf{1}_3$ is a normal to the curve $(D^+, E_1^+)$ at the point $p_{3,4}$. While, a curve $(D, E_1)$ is a concurrence of points $p_5$, each defined by transferring the point $p_{3,4}$ along the normal $\mathbf{1}_3$ by a distance corresponding to a radius r of the orbital circle R. According to this transfer, the starting point $p_1$ of the curve $(D^+, E_1^+)$ is transferred to a point $p_6$. This curve $(D, E_1)$ is referred to as an "intermediate curve".

If x and y components of the distance r along the normal $\mathbf{1}_3$ are $a_x$ and $b_y$, respectively, r is defined by $$r^2=a_x^2+b_y^2 \tag{3}$$

If the point $p_5$ has coordinates (X, Y), X, x and Y, y are related by $$X-x=a_x$$

$$Y-y=b_y \tag{4}$$

The relationship between the points $p_{3,4}$ (x, y) and $p_5$ (X, Y) is expressed by $$r^2=(X-x)^2+(Y-y)^2 \tag{5}$$

From equations (4) and (5), the following is obtained:

$$X^2+Y^2=x^2+y^2+r^2+2\,(xa_x+yb_y) \tag{6}$$

x and y are also expressed as a function of $\theta$ by $$x=A\cos\theta+A\theta\sin\theta$$

$$y=-A\theta\cos\theta+A\sin\theta \tag{7}$$

As shown in FIG. 6, $a_x$ and $b_y$ are defined as a function of angle $\beta$ formed between the normal $\mathbf{1}_3$ and a straight line $\mathbf{1}_y$ passing the point $p_{3,4}$ in parallel to y axis by $$a_x=r\cos(\beta-\pi/2)$$

$$b_y r\sin(\beta-\pi/2) \tag{8a}$$

when $\theta$ is in first and third quadrants, and $$a_{x=r}\cos(\beta+\pi/2)$$

$$b_y=r\sin(\beta+\pi/2) \tag{8b}$$

when $\theta$ is in second and fourth quadrants.

From equations (6), (7) and (8*a*), the following is obtained $$X^2+Y^2=x^2+y^2+r^2+2rA[\sin\beta(\cos\theta+\theta\sin\theta)-\cos\beta(-\theta\cos\theta+\sin\theta)] \tag{9a}$$

From equations (6), (7) and (8*b*), the following is obtained $$X^2+Y^2=x^2+y^2+r^2+2rA[-\sin\beta(\cos\theta+\theta\sin\theta)-\cos\beta(-\theta\cos\theta+\sin\theta)] \tag{9b}$$

However, it is apparent that these two equations (9*a*), (9*b*) are identical when the tangent $l_1$ and the normal $l_3$ are coincident with each other with reference to the relationship of $\beta=\theta-\pi$.

When the curve $(D^+, E_1^+)$ is a pure involute curve $D^+$, the normal $\mathbf{1}_3$ is coincident with the tangent $\mathbf{1}_1$. This is proved as follows:

If coordinates of the point $p_2$ on the basic circle $C_1$ at an involute angle $\theta$ is $(x_0, y_0)$ a gradient $dy_0/dx_0$ of the tangent $\mathbf{1}_1$ is defined by $$dy_0/dx_0=(y-y_0)/(x-x_0) \tag{10}$$

As $x_0=A\cos\theta$ and $y_0=A\sin\theta$, the equation (10) is represented by $$dy_0/dx_0=-1/\tan\theta \tag{11}$$

By differentiating the equation (1) for x, the following is obtained:

$$x+y\,dy/dx=A^2\theta\,d\theta/dx \quad (12)$$

By differentiating x in the equation (7) for $\theta$, the following is obtained:

$$dx/d\theta=A\theta\cos\theta \quad (13)$$

From the equations (12) and (13), the gradient dy/dx of the tangent of $1_2$ is represented by $$dy/dx=(A/\cos\theta-x)/y \quad (14)$$

By substituting x, y in the equation (14) by the equation (7), the following is obtained:

$$dy/dx=\tan\theta \quad (15)$$

The equation (15) shows that the tangents $1_1$ and $1_2$ intersect with each other at a right angle. Thus, it is apparent from the equation (11) that, if the curve ($D^+$, $E_1^+$) is a pure involute curve $D^+$, the gradients of the normal $1_3$ and the tangent $1_1$ coincide with each other.

Accordingly, $\beta$ is equal to $(\theta-\pi)$, and the equations (9*a*) or (9*b*) is converted $$X^2+Y^2=x^2+y^2+r^2+2rA[\sin\theta(\cos\theta+\theta\sin\theta)-\cos\theta(-\theta\cos\theta+\sin\theta)] \quad (16)$$

This equation (16) is simplified to $$X^2+Y^2=x^2+y^2+r^2+2rA\theta \quad (17)$$

From the equations (1) and (17), the following is obtained:

$$X^2+Y^2=A^2+A^2\theta^2+r^2+2rA\theta \quad (18)$$

Substitution of r in the equation (18) by A $\alpha$ results in $$X^2+Y^2=A^2+A^2(\theta+\alpha)^2 \quad (19)$$

This means that if the curve ($D^+$, $E_1^+$) is a pure involute curve $D^+$, the intermediate curve (D, $E_1$) also becomes a pure involute curve D obtained through the clockwise rotational transfer of the curve $D^+$ around the origin $O_1$ by an angle $\alpha$. A profile of the conventional inner wall is defined by an involute curve $D^{31}$ in FIG. 7, obtained by the symmetrical transfer, i.e., 180° rotational transfer of the intermediate curve D around the center of the basic circle $C_1$. Accordingly, the curve $D^-$ is also obtained by the counterclockwise rotational transfer of the involute curve D around the origin $O_1$ by an angle $(\pi+\alpha)$.

As the normal $1_3$ and the tangent $1_1$ coincide with each other, the normals $1_3$ at the starting point $p_1$ (A, O) of the involute curve D is parallel to y axis, and the point $p_1$ is transferred in parallel to y axis to the starting point $p_6$ (A, −r) of the curve D. The point $p_6$ is further transferred to a starting point $p_7$ (−A, r) of the curve D by the symmetrical transfer around the origin.

Figure 7:
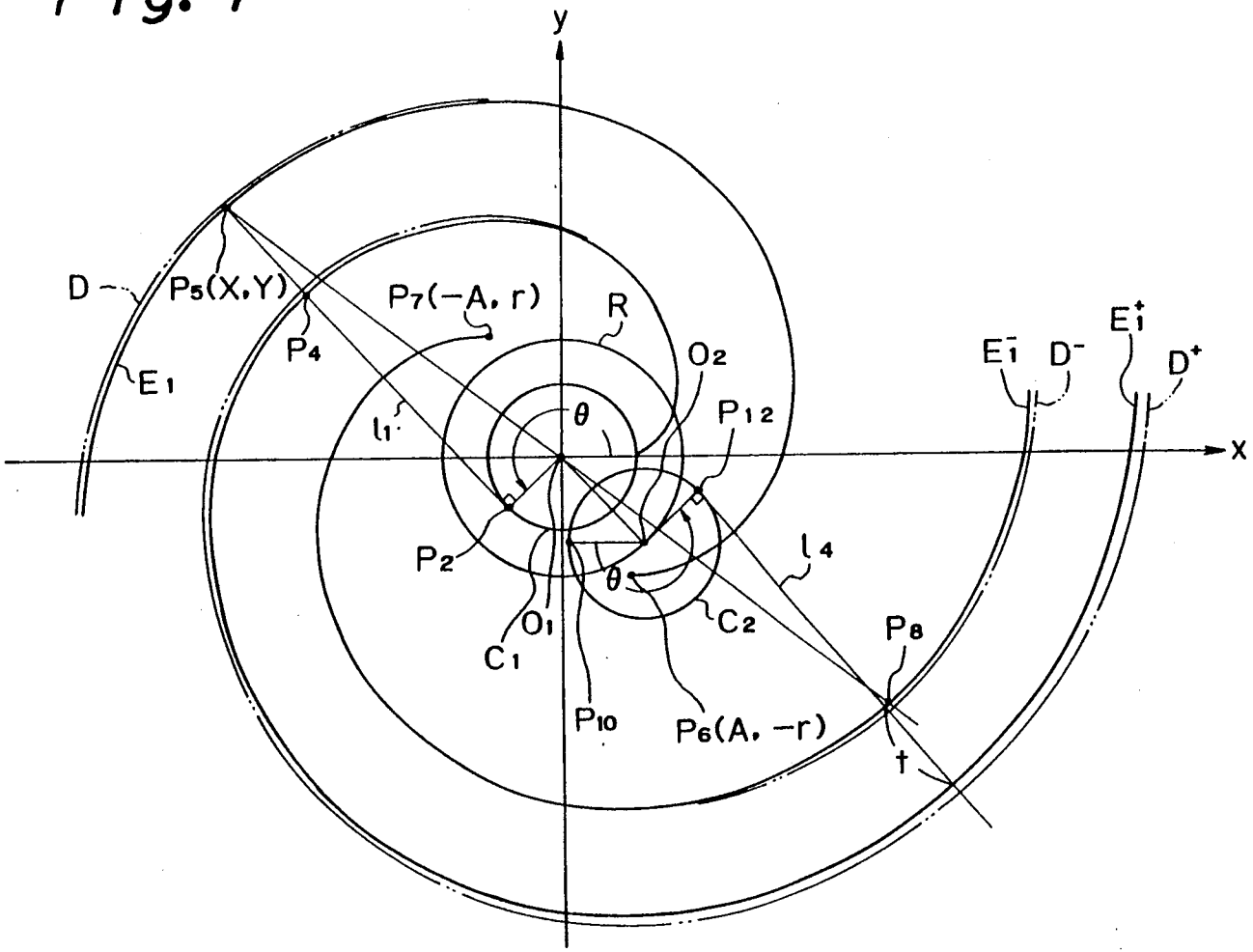

An inner wall curve $E_1^-$ corresponding to the outer wall curve $E_1^+$ defined by equation (2) is obtained in a similar manner as the case of obtaining the involute curve $D^-$ from the involute curve $D^+$ described above. That is, first a curve $E_1$ is formed by transferring the outer wall curve $E_1^-$ along the normal $1_3$ at a distance corresponding to radius r of the orbital circle, and then the inner wall curve $E_1^-$ is obtained by the symmetrical transfer of $E_1$ around the origin. A point $p_8$ in FIG. 7 represents a position of a point $p_5$ (X, Y) on the curve $E_1$ after the symmetrical transfer around the origin has been completed.

The curve $E^+$ is represented by $$(X-a_x)^2+(Y-b_y)^2=A^2+(A\theta-B\theta^n)^2 \quad (20)$$

The curve $E_1^-$ is represented by $$(X+a_x)^2+(Y+b_y)^2=A^2+(A\theta-B\theta^n)^2 \quad (21)$$

Figure 8:
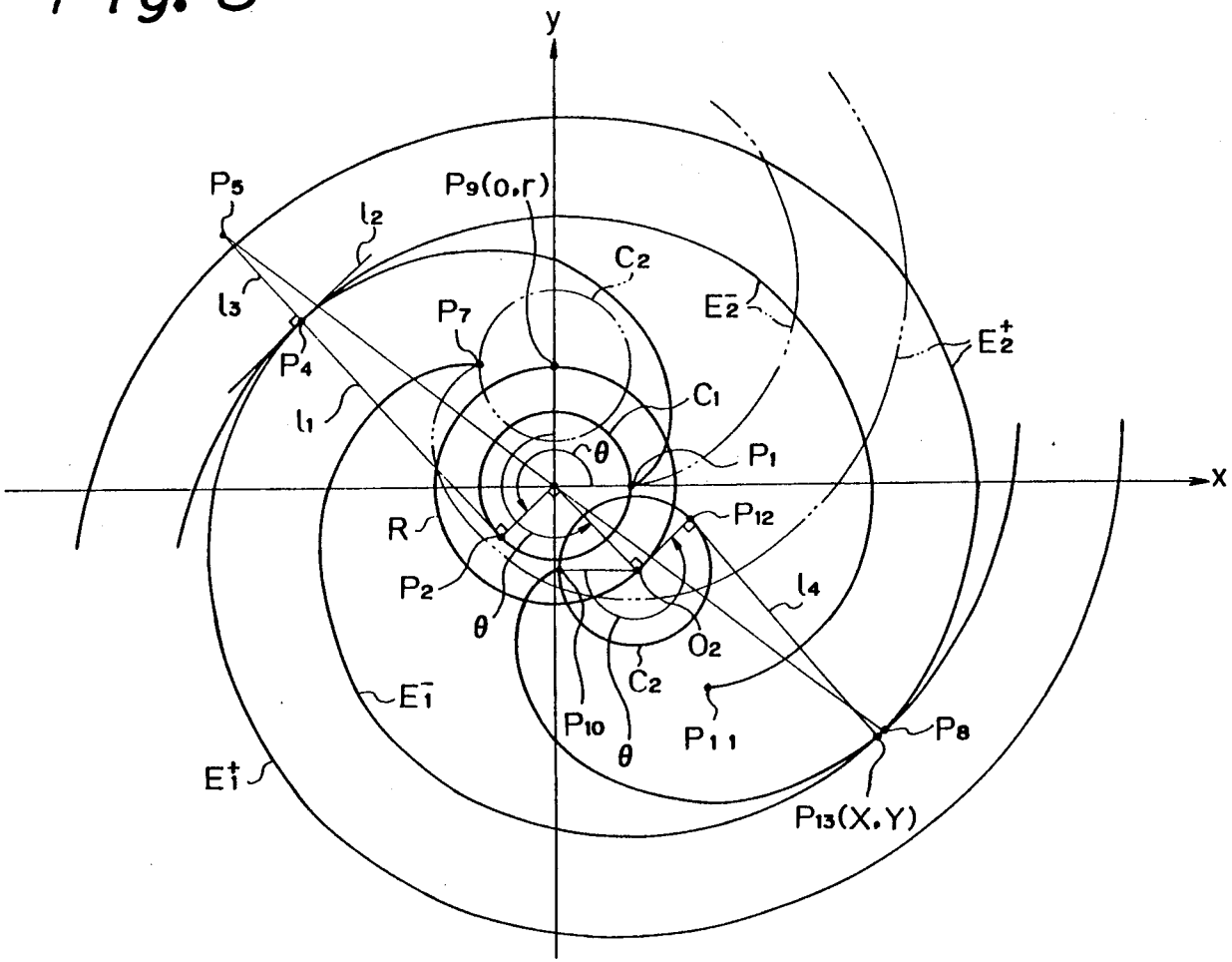
FIGS. 8 and 9 are schematic views, respectively, illustrating the contact between outer and inner walls of the stationary and movable scrolls according to the present invention.

An outer wall curve $E_2^+$ and an inner wall curve $E_2^{31}$ of the movable scroll are identical to the outer and inner wall curves $E_1^+$ and $E_1^-$ of the stationary scroll, respectively. FIG. 8 illustrates the contact between the outer wall curve $E_1^+$ of the stationary scroll 1 and the inner wall curve $E_2^-$ of the movable scroll 2 and between the inner wall curve $E_1^-$ of the stationary scroll 1 and the outer wall curve $E_2^+$ of the movable scroll 2. The inner and outer wall curves $E_2^-$ and $E_2^+$ of the movable scroll 2 are obtained by symmetrically transferring the inner and outer wall curves $E_1^-$ and $E_1^+$ of the stationary scroll 1 around the origin, and further, transferring the resultant curves so that the center of the basic circle $C_1$ is positioned on the orbital circle R. A circle $C_2$ in FIG. 8 is a basic circle of the outer wall curve $E_2^+$.

When a center $O_2$ of the basic circle $C_2$ coincides with a point $p_9$ (O, r) on the orbital circle R as shown in FIG. 8 by an imaginary line, a starting point $p_{10}$ of the outer wall curve $E_2^+$ of the movable scroll 2 coincides with the starting point $p_7$ (−A, r) of the inner wall curve $E_1^-$ of the stationary scroll 1 and a starting point $p_{11}$ of the inner wall curve $E_2^-$ of the movable scroll 2 coincides with the starting point $p_1$ (A, 0) of the outer wall curve $E_1^+$ of the stationary scroll 1. The basic circle $C_2$ shown by an imaginary line having a center at the point $p_9$ (0, r) is transferred to a position shown by a solid line so that the center thereof coincides with a point $O_2$ by the counterclockwise rotational transfer at an angle $\theta$ on the orbital circle R. Then straight lines $p_2-O_1$ and $O-O_2$ intersect with each other at a right angle. If a position at an involute angle $\theta$ on the basic circle $C_2$ shown by a solid line is a point $p_{12}$, straight lines $O_2-p_{12}$ and $O_1-O_2$ intersect with each other at a right angle. Accordingly, a point $p_{13}$ on the outer wall curve $E_2^+$ of the movable scroll 2 corresponds to the point $p_4$ on the outer wall curve $E_1^+$ of the stationary scroll 1 at an involute angle $\theta$. The point $p_{13}$ does not coincide with the point $p_8$ on the inner wall curve $E_1^+$ of the stationary scroll 1 in FIGS. 7 and 8. This is because the gradient of the normal $1_3$ at the point $p_4$ on the outer wall curve $E_1^+$ is different from that of the tangent $1_1$.

However, since the points $p_8$ and $p_{13}$ are distant from each other only in the tangential direction on the curve $E_1^-$ or $E_2^+$ but the deviation therebetween is almost zero in the normal direction, both the scrolls 1 and 2 are considered to be in contact with each other in the close vicinity of the points $p_4$ and $p_{13}$. This can be explained as follows:

If x-component and y-component of $B\theta^n$ are $\Delta x$ and $\Delta y$, respectively, coordinates of the point $p_{13}$ (X, Y) are represented by $$X = x - \Delta x$$

$$Y = y - \Delta y \tag{22}$$

As the gradient of the tangent $\mathbf{1}_4$ is $-1/\tan\theta$, $\Delta x$ and $\Delta y$ are expressed by $$\Delta x = B\theta^n \cdot \sin\theta$$

$$\Delta y = -B\theta^n \cdot \cos\theta \tag{23}$$

By differentiating the equation (2) while substituting X, Y for x, y, respectively, the following is derived:

$$X + Y\, dY/dX = (A\theta - B\theta^n)(A - Bn\theta^{n-1})d\theta/dX \tag{24}$$

By substituting (24) for (22), the following equation is derived:

$$(x - B\theta^n \sin\theta) + (y + B\theta^n \cos\theta)dY/dX = (A\theta - B\theta^n)(A - Bn\theta^{n-1})d\theta/dX \tag{25}$$

From the equations (22) and (23), $dX/d\theta$ is obtained as follows:

$$\begin{aligned} dX/d\theta &= dx/d\theta - B(n\theta^{n-1}\sin\theta + \theta^n\cos\theta) \\ &= A\theta\cos\theta - B(n\theta^{n-1}\sin\theta + \theta^n\cos\theta) \end{aligned} \tag{26}$$

If $n=2$ and $\theta=\pi$, for example, the following equation is obtained from (25) and (26):

$$dY/dX = 2B/(A - B\pi) \tag{27}$$

The equation (27) represents the gradient of tangent on the basic circle $C_2$ at an involute angle $\pi$. If $A=0.5$ cm and $B=0.001$, $dY/dX$ is 0.004. While, according to the equation (15), $dy/dx$ is 0. The difference therebetween is substantially on the same order at other involute angles. That is, an intersecting angle $\Delta\theta$ between the normals at points $p_{13}$, $p_8$ is nearly equal to 0.004 radian. This means that, when the orbital radius r is 1 cm, the distance between points $p_{13}$ and $p_8$ has a tangential component of $0.004 \times 1$ cm $= 0.004$ cm and a normal component of 0.004 cm $\times 0.004 = 0.000016$ cm. The normal component of 0.000016 cm is within a manufacturing tolerance of the scroll wall. Accordingly, the inner and outer wall curves $E_1^-$, $E_1^+$ of the stationary scroll 1 and the inner and outer wall curves $E_2^{31}$, $E_2^+$ of the movable scroll 2 can be substantially always in contact with each other when the movable scroll 2 is subjected to an orbital motion.

The outer wall curve $E_1^+$ expressed by equation (2) is also represented by $$L_1(\theta) = A\theta - B\theta^n \tag{28}$$

Similarly, the inner wall curve $E_1^-$ defined by equation (21) is also represented by $$L_2(\theta) = A(\theta - \pi) - B(\theta - \pi)^n \tag{29}$$

As shown in FIG. 7, a wall thickness t of the stationary scroll 1 in the direction of tangent $\mathbf{1}_4$ on the basic circle $C_2$ of the inner and outer wall curves $E_1^-$ and $E_1^+$ is represented as follows:

$$t(\theta) = L_1(\theta) - L_2(\theta - \pi) \tag{30}$$

If $n=2$, the equation (30) is converted to $$t(\theta) = A\pi - 2B\theta\pi + B\pi^2 \tag{31}$$

That is, the wall thickness t is linearly reduced as an involute angle is increased. This is also true for the case in which n is more than three. Accordingly, the start area of the scroll wall subjected to a severe high pressure is strengthened by increasing the wall thickness and the end area thereof not subjected to such a high pressure can be thinned, whereby the weight of a compressor can be reduced.

As illustrated in FIG. 1, the stationary scroll has maximum involute angle $\theta$ of about $11\pi/2$ in the embodiment described. A length $L_1$ of involute line corresponding to the involute angle $\theta$ of $11\pi/2$ is about 8.337 cm which is shorter than $L_0$ of 8.635 cm in the case of the pure involute curve $D^+$. Since a radius of the stationary scroll 1 corresponds to this length $L_1$, it is apparent that a size of the compressor also can be reduced.

Figure 9:
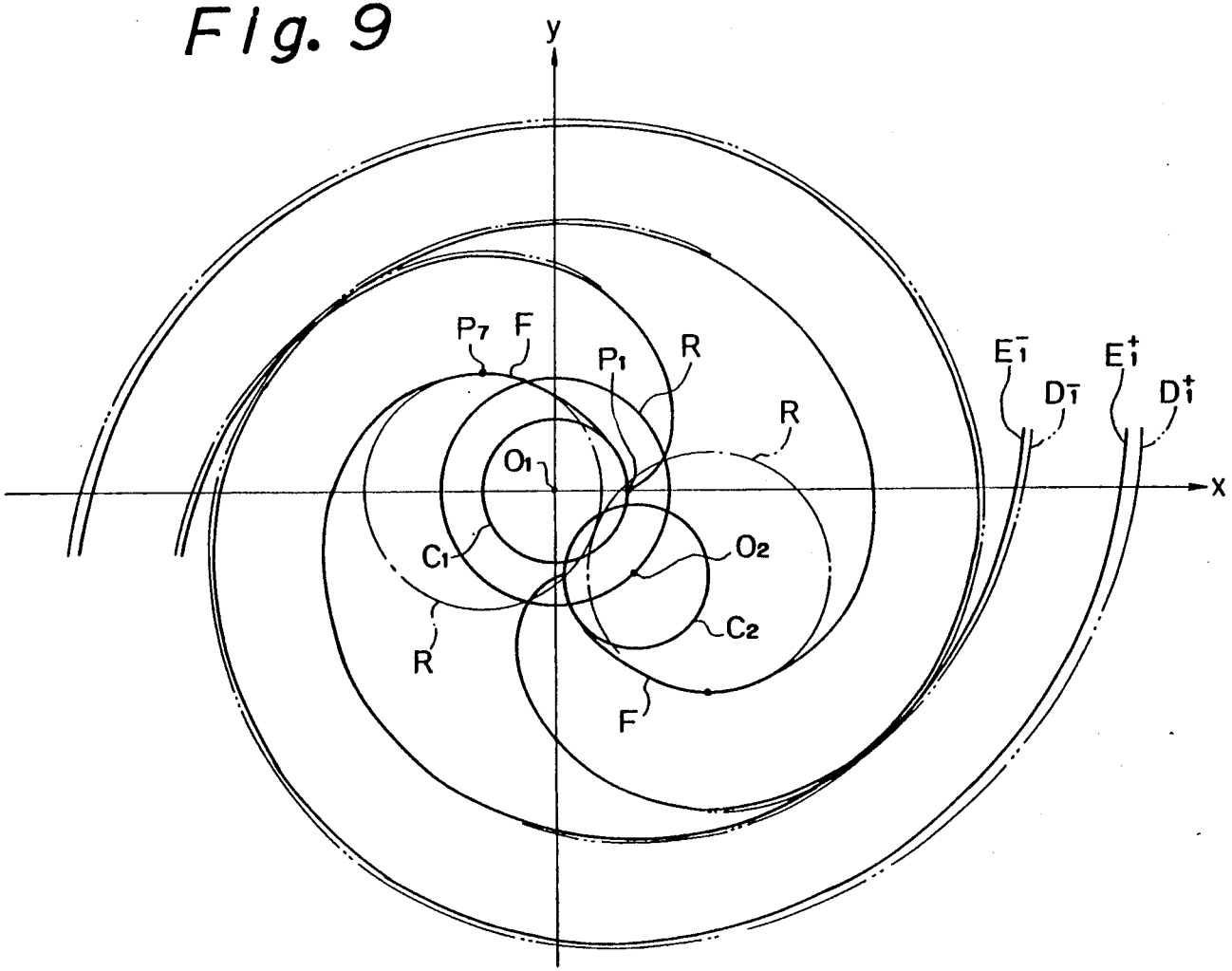

According to this embodiment, as shown in FIG. 9, a starting point $p_1$ of the outer wall curve $E_1^+$ and a starting point $p_7$ of the inner wall curve $E_1^-$ are smoothly connected by a curve F not invading the orbital circle R.

The present invention is not limited to the above embodiment. When an inner wall curve is generated from an outer wall curve, points on the outer wall curve may not be shifted strictly in the normal direction but in the approximately normal direction. For example, they may be shifted in the direction of the involute line provided a coefficient B is properly modified. The resultant curves are smoothly in contact with each other.

We claim:

1. A scroll type compressor comprising a stationary scroll and a movable scroll, outer and inner walls of the movable scroll confronting those of the stationary scroll and being supported to be subjected to an orbital motion along an orbital circle while prevented from spinning around its own axis, a sealed space being formed between both the scrolls which is reduced in volume when the movable scroll is subjected to the orbital motion, profiles of walls of both scrolls being defined by a curve generated from a modification of an involute curve of a basic circle, characterized in that the curve defining a profile of the outer wall (outer wall curve) is generated from a basic involute curve by reducing a certain value from a length of the respective involute line of the basic involute curve, which value is increased as the involute angle is developed; and the curve defining a profile of the inner wall (inner wall curve) is generated from the outer wall curve by first transferring the respective point on the outer wall curve substantially in the normal direction to the outer wall curve at the respective point by a distance equal to a radius of the orbital circle to form an intermediate curve and then symmetrically transferring the respective point on the intermediate curve around the center of the basic circle;

wherein the involute line is defined by a segment of tangent to the basic circle at the respective involute angle between the involute curve and the basic circle.

2. A scroll type compressor as defined by claim 1, characterized in that, in the generation of the intermediate curve, the respective point on the outer wall curve is transferred correctly in the normal direction.

3. A scroll type compressor as defined by claim 1, characterized in that, in the generation of the intermediate curve, the respective point of the outer wall curve is transferred in the direction of the involute line at the respective point.

4. A scroll type compressor as defined by claim 1, characterized in that the profile of the outer wall curve is defined on x-y co-ordinates by the following equation $$X^2+Y^2=A^2+(A\theta-B\theta^n)^2$$

wherein A is a radius of the basic circle, B is a positive constant, n is an exponent of more than two, and $\theta$ is an involute angle.

* * * * *

UNITED STATES PATENT AND TRADEMARK OFFICE

CERTIFICATE OF CORRECTION

PATENT NO. : 5,151,020

DATED : September 29, 1992

INVENTOR(S) : T. Mori et al

It is certified that error appears in the above-identified patent and that said Letters Patent is hereby corrected as shown below:

Column 3, line 39, "substrate" should read --subtracting--

Column 4, line 24, "$b_y{}^r$" should read --$b_y$ = r sin--; line 59, before "a" insert comma --,--.

Column 5, line 51, "$D^{31}$" should read --$D^-$--; line 63, "D" should read --$D^-$--.

Column 6, line 2, "$E_1{}^-$" should read --$E_1{}^+$; line 9, "$E^+$" should read --$E_1{}^+$--; line 18, "$E_2{}^{31}$" should read --$E_2{}^-$--.

Column 7, line 51, "$E_2{}^{31}$," should read --$E_2{}^-$,--.

Signed and Sealed this

Eleventh Day of January, 1994

Bruce Lehman

*Attest:*

BRUCE LEHMAN

*Attesting Officer*

*Commissioner of Patents and Trademarks*